US006142814A

United States Patent [19]

Wu et al.

[11] Patent Number: 6,142,814

[45] Date of Patent: Nov. 7, 2000

[54] GUIDE POST OF ELECTRICAL CONNECTOR

[75] Inventors: Kun-Tsan Wu, Tu-Chen; Johnson Yang, Tai-Shan, both of Taiwan

[73] Assignee: Hon Hai Precision Ind. Co., Ltd., Taipei Shein, Taiwan

[21] Appl. No.: 09/334,705

[22] Filed: Jun. 16, 1999

[30] Foreign Application Priority Data

Nov. 17, 1998 [TW] Taiwan ..... 87219014

[51] Int. Cl.[7] ..... H01R 13/54; H01R 4/38

[52] U.S. Cl. ..... 439/378; 439/383

[58] Field of Search ..... 439/378, 379, 439/380, 381, 101, 108, 607, 825, 826, 827, 828

[56] References Cited

U.S. PATENT DOCUMENTS

| | | | |
|---|---|---|---|
| 371,840 | 10/1887 | Heffner et al. | 439/378 |
| 5,092,774 | 3/1992 | Milan | 439/66 |
| 6,007,364 | 12/1999 | Wu | 439/378 |

*Primary Examiner*—Brian Sircus
*Assistant Examiner*—Chandrika Prasad
*Attorney, Agent, or Firm*—Wei Te Chung

[57] ABSTRACT

A guide post (80) is adapted to be mounted to a first electrical connector for being received in a receptacle hole defined in a mating second connector to guide the mating operation of the connectors. The guide post has a threaded rear section (101) threadingly engaging with an inner-threaded hole defined in the first connector and a front section (102) extending beyond the first connector and insertable into the receptacle hole of the second connector. A hexagonal intermediate section (104) is formed between the rear section and the front section. A helical spring (20) having a first end supported on the intermediate section surrounds the front section and is retained thereon by a washer (30) which is movably fit over the front section and engages with a second end of the spring. A cap (40) is fixed to a free end of the front section to retain the washer thereon. The washer has a size greater than the receptacle hole thereby abutting against the second connector for compressing the spring, which in turn provides a buffering force between the two connectors.

18 Claims, 4 Drawing Sheets

GUIDE POST OF ELECTRICAL CONNECTOR

BACKGROUND OF THE INVENTION

1. Field of the Invention

The present invention generally relates to a guide post of an electrical connector for guiding the connector into mating engagement with a mating connector, and in particular to an electrical connector guide post having a buffering element for reducing an impact force between the connectors.

2. The Prior Art

Electrical connectors that engage with mating connectors to establish electrical connection and transfer signals therebetween are well known in the electronics field. A mating force is required to physically connect the connectors together. To ensure proper connection and to maintain secure engagement between the connectors, guiding means is often adapted in the connectors. Related examples are disclosed in U.S. Pat. Nos. 5,446,171 and 5,478,253. The guiding means of the conventional connector comprises an elongate post which is inserted into a hole defined in the mating connector. In the conventional connectors, the mating force required to physically attach the connector to the mating connector directly acts upon the connectors whereby an unintentionally excessive mating force may damage the connectors when inserting the post into the hole.

It is thus desirable to provide a guide post which has a buffering spring for reducing a mating force thereby decreasing the likelihood of damaging the connectors.

SUMMARY OF THE INVENTION

Accordingly, an object of the present invention is to provide an electrical connector having a guide post with a buffering element for reducing an impact force acting upon the connector.

Another object of the present invention is to provide an electrical connector having a guide post with a buffering spring which electrically engages with the mating connector for providing EMI (Electro-Magnetic Interference) protection.

A further object of the present invention is to provide an electrical connector having a guide post with a buffering element for reducing the risk of damage incurred on the connectors when engaging the connectors.

To achieve the above objects, a guide post in accordance with the present invention is adapted to be mounted to a first electrical connector for being received in a receptacle hole defined in a mating second connector to guide the mating operation of the connectors. The guide post has a threaded section threadingly engaging with an inner-threaded hole defined in the first connector and a post section extending beyond the first connector and insertable into the receptacle hole of the second connector. A hexagonal intermediate section is formed between the threaded section and the post section. A helical spring having a first end supported on the intermediate section surrounds the post section and is retained thereon by a washer which is movably fit over the post section and engages with a second end of the spring. A cap is fixed to a free end of the post section to retain the washer thereon. The washer has a size greater than the receptacle hole thereby abutting against the second connector for compressing the spring which in turn provides a buffering force between the two connectors.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
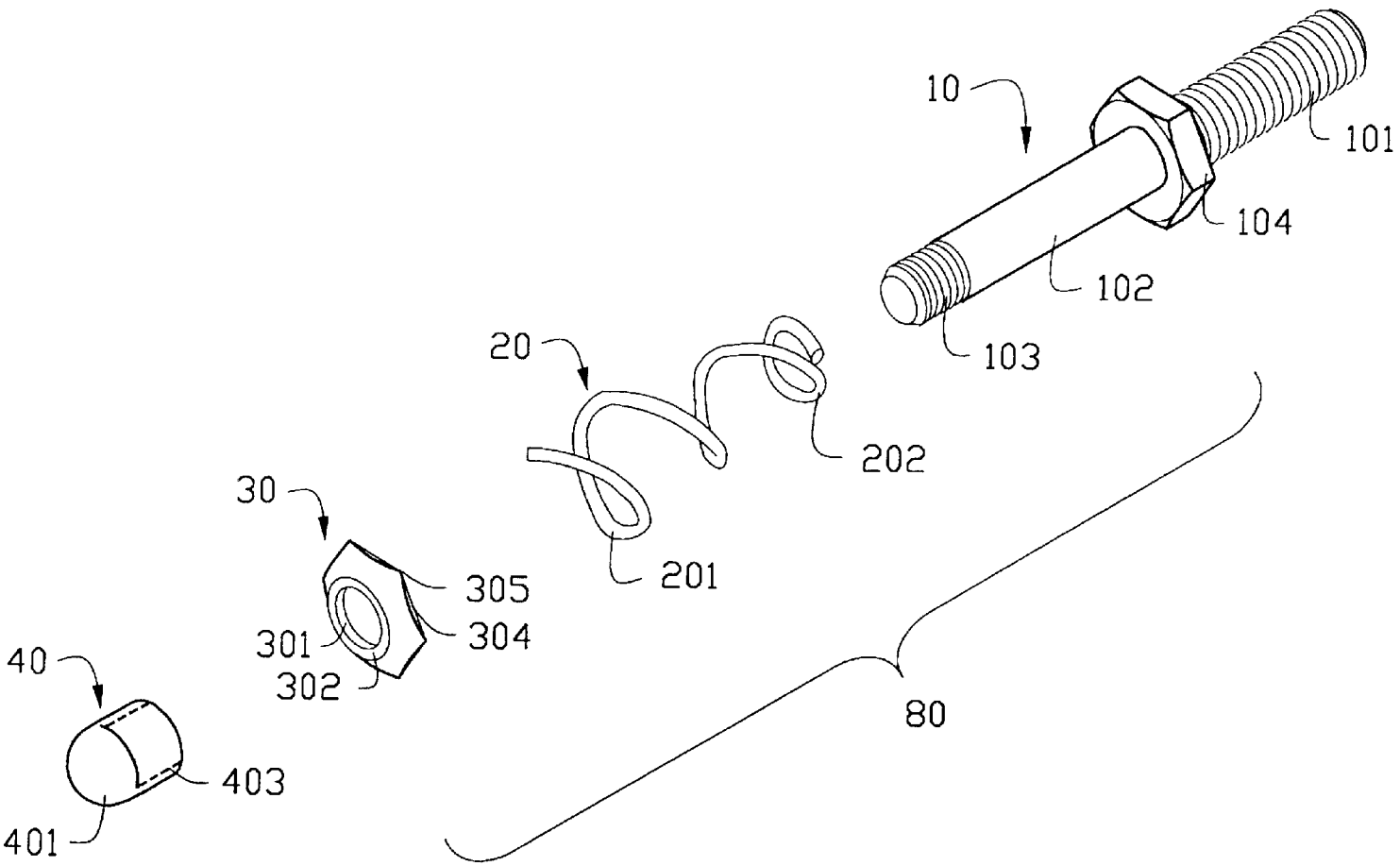
FIG. 1 is an exploded view of a guide post in accordance with the present invention.
Figure 2:
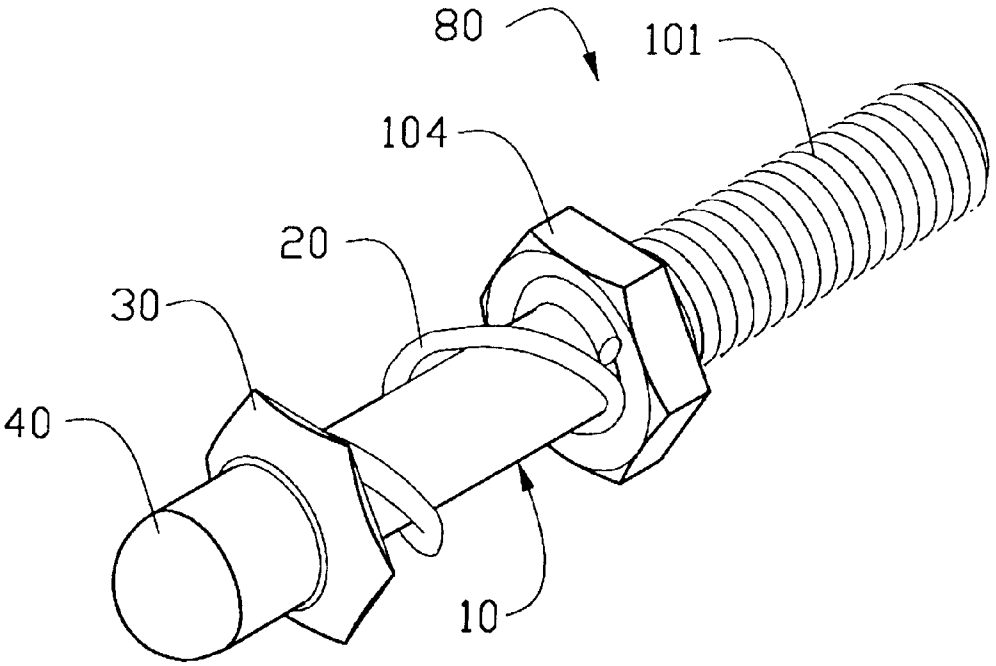
FIG. 2 is an assembled view of FIG. 1.

Referring to the drawings and in particular to FIGS. 1 and 2, a guide post 80 in accordance with the present invention comprises an elongate post body 10 having a front section 102 and a rear section 101 extending from an expanded intermediate section 104 in opposite directions. The rear section 101 is externally threaded and the front section 102 has a threaded free end 103.

Preferably, the intermediate section 104 has a polygonal cross section, such as a hexagon as shown in the drawings, for facilitating engagement with an external tool such as a wrench (not shown).

A cap 40 has an inner-threaded hole 403 for engaging with and securing to the threaded free end 103 of the front section 102 of the post body 10. The cap 40 has a rounded end 401.

A helical spring 20 is fit over the front section 102 of the post body 10 with a first end 202 supported on the expanded intermediate section 104 and a second end 201 abutting against the cap 40 via a washer 30 positioned therebetween. The washer 30 has a central bore 301 which is greater in diameter than the front section 102 of the post body 10 and is thus movable with respect to the post body 10. The washer 30 has a first face 302 engaging with the cap 40 and a second face 304 engaging with and supported by the second end 201 of the spring 20.

Preferably, the helical spring 20 has a conical configuration whereby the second end 201 has a diameter greater than the first end 202 thereby allowing the spring 20 to be compressed into a flat coil for promoting an efficient use of space.

Figure 3:
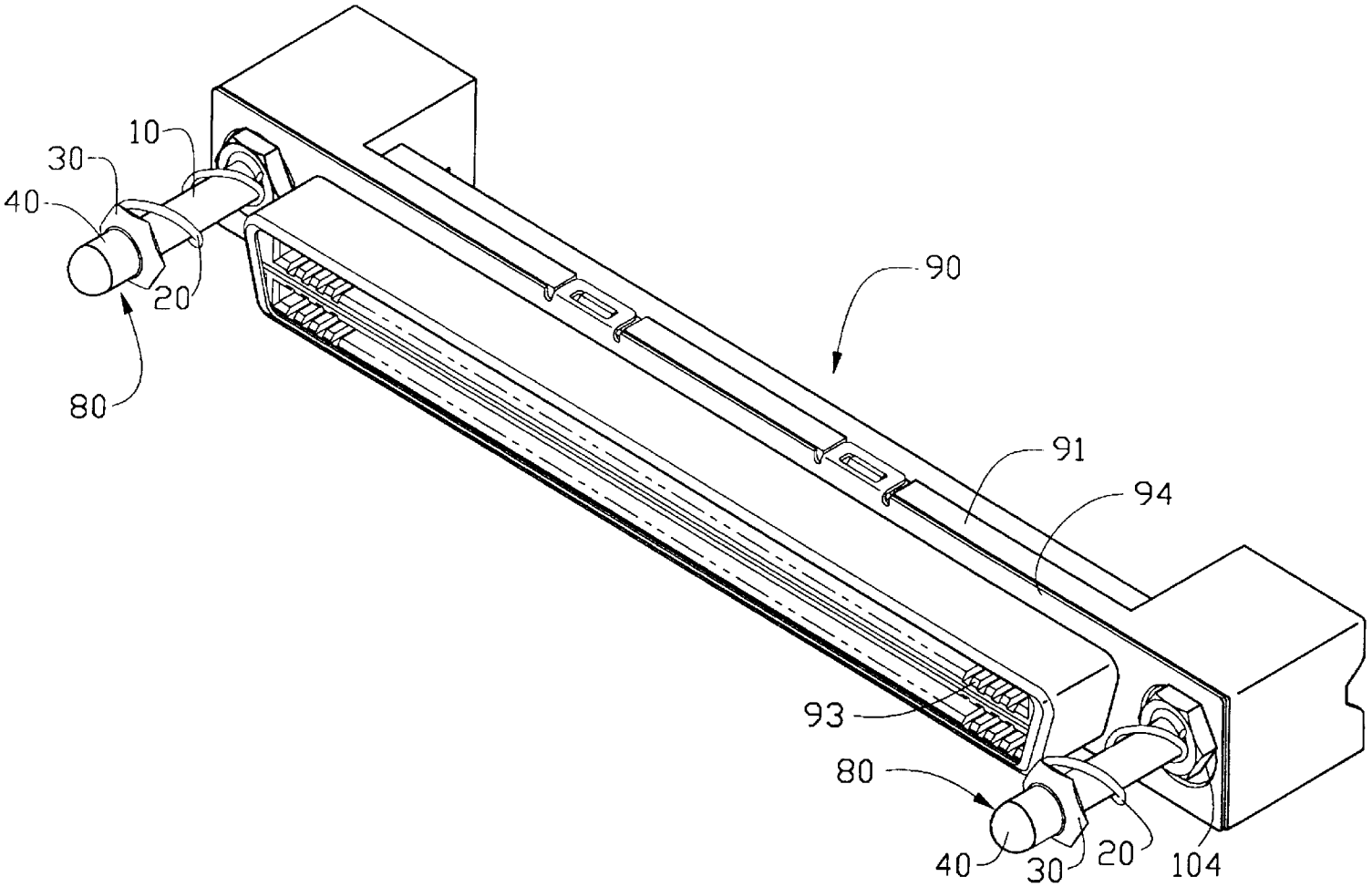
FIG. 3 is a perspective view of an electrical connector having two guide posts of the present invention mounted therein.

FIG. 3 shows the electrical connector 90 having two guide posts 80 of the present invention mounted therein. The electrical connector 90 comprises an insulative housing 91 receiving and retaining a plurality of contact elements 93 therein. A shielding member 94 is mounted to the housing 91 for grounding and EMI (Electro-Magnetic Interference) protection purposes. The housing 91 has two inner-threaded holes 92 (FIG. 4) with which the threaded sections 101 of the post bodies 10 of the guide posts 80 engage whereby the front sections 102 of the guide posts 80 extend beyond the connector 90.

Although the helical spring 20 is described to have the first end 202 thereof supported on the expanded intermediate section 104, it is apparent that the first end 202 of the spring 20 may be directly supported on the housing 91 of the connector 90 and the expanded intermediate section 104 may be removed.

Figure 4:
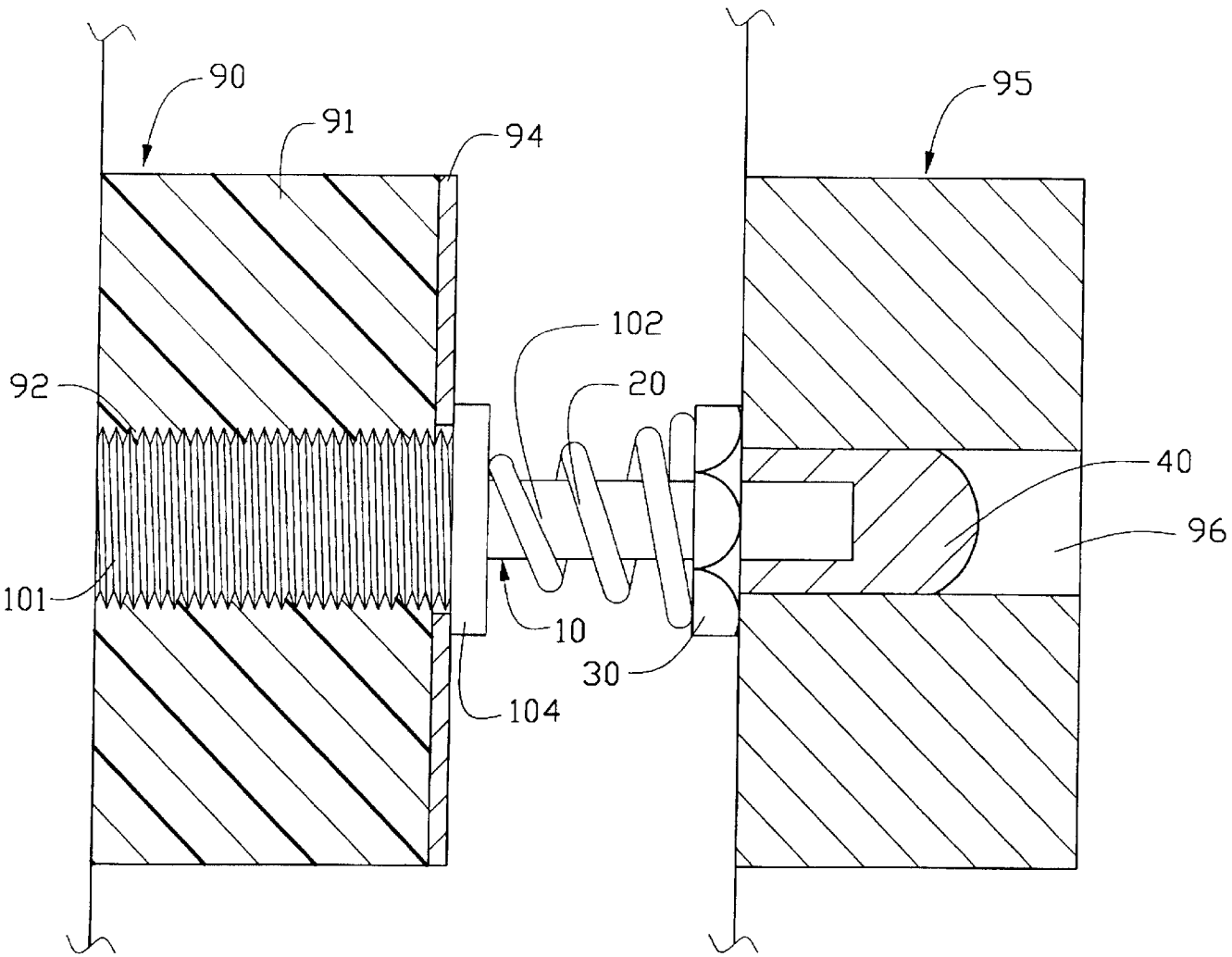
FIG. 4 is a cross-sectional view showing the engagement between two connectors guided by the guide post of the present invention.

Also referring to FIG. 4, the connector 90 is mateable with a mating connector 95 for electrically engaging the contact elements 93 with counterpart contacts (not shown) of the mating connector 95. The mating connector 95 defines receptacle holes 96 therein for receiving the front sections 102 of the guide posts 80. When inserting the guide post 80 into the corresponding receptacle hole 96 for mating the two connectors 90, 95, the cap 40 is disposed in the hole 96 and the washer 30 abuts against the mating connector 95. In this respect, the washer 30 has a size greater than the hole 96. The rounded end 401 of the cap 40 facilitates the insertion of the cap 40 into the receptacle hole 96. A mating force is applied to the connectors 90, 95 to compress the spring 20 which brings the connectors 90, 95 toward each other and the contact elements 93 electrically engage with the counterpart contacts of the mating connector 95.

The compression of the spring 20 provides a buffering force between the two mating connectors 90, 95 thereby reducing the likelihood of damage incurred on the connectors 90, 95 by means of an excessive mating force. In addition, the mating connector 95 generally is also covered by a shield (not shown) on the corresponding mating face, and thus under this situation, the compression of the spring 20 biases the washer 30 firmly against such a shield of the mating connector 95 thereby forming a secure electrical engagement therewith for providing EMI/ESD protection between the connectors 90, 95.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A guide post adapted to be mounted to a first connector for being received in a receptacle hole defined in a mating second connector to guide the first connector into mating engagement with the second connector, the guide post comprising a front section extending from the first connector and insertable into the receptacle hole of the second connector, a cap being mounted to a free end of the front section, the cap being sized to be received in the receptacle hole, a helical spring being fit over the front section and retained between the first connector and the cap, a washer being movably fit over the front section and positioned between the cap and the spring for retaining the spring, the washer having a size greater than the receptacle hole of the second connector whereby when mating the first connector with the second connector, the front section is inserted into the receptacle hole, the washer abuts against the second connector, and the spring is compressed thereby providing a buffering force between the first connector and the second connector.

2. The guide post as claimed in claim 1, wherein the cap has a rounded free end.

3. The guide post as claimed in claim 1, wherein the free end of the front section has a threads thereon, and wherein the cap has an inner-threaded hole for threadingly engaging with the threads of the free end of the front section.

4. The guide post as claimed in claim 1 further comprising an externally-threaded rear section threadingly engaging with an inner-threaded hole defined in the first connector for mounting the guide post in the first connector.

5. The guide post as claimed in claim 4, wherein an expanded intermediate section is formed between the front section and the rear section for supporting the helical spring.

6. The guide post as claimed in claim 4, wherein an intermediate section is formed between the front section and the rear section, the intermediate section having a polygonal cross section.

7. The guide post as claimed in claim 6, wherein the polygonal cross section is hexagonal.

8. The guide post as claimed in claim 6, wherein the helical spring has a conical configuration with a first end supported on the intermediate section and a second end engaging with the washer, the second end having a diameter greater than the first end.

9. An electrical connector comprising an insulative housing retaining contact elements therein and adapted to mate with a second connector for electrically engaging the contact elements with counterpart contacts of the second connector and guiding means mounted to the housing for guiding the electrical connector into mating engagement with the second connector, the guiding means having at least one front section extending from the electrical connector and receivable in a receptacle hole defined in the second connector, a washer movably fit over the front section and retained by a cap fixed to a free end of the front section, and a helical spring fit over the front section and retained between the washer and the electrical connector, the washer having a size greater than the receptacle hole thereby abutting against the second connector for compressing the spring during the mating operation whereby the spring provides a buffering force between the electrical connector and the second connector.

10. The electrical connector as claimed in claim 9, wherein the cap has a rounded free end.

11. The electrical connector as claimed in claim 9, wherein the free end of the front section has threads thereon, and wherein the cap has an inner-threaded hole for threadingly engaging with the threads of the free end of the front section.

12. The electrical connector as claimed in claim 9 further comprising an externally-threaded rear section threadingly engaging with an inner-threaded hole defined in the electrical connector for mounting the guiding means to the electrical connector.

13. The electrical connector as claimed in claim 12, wherein an expanded intermediate section is formed between the front section and the rear section for supporting the helical spring.

14. The electrical connector as claimed in claim 12, wherein an intermediate section is formed between the front section and the rear section, the intermediate section having a polygonal cross section.

15. The electrical connector as claimed in claim 14, wherein the polygonal cross section is hexagonal.

16. The electrical connector as claimed in claim 14, wherein the helical spring has a conical configuration with a first end supported on the intermediate section and a second end engaging with the washer, the second end having a diameter greater than the first end.

17. An electrical connector assembly comprising:

a first connector including an insulative housing defining a front face thereon;

a shielding member attached to said front face of the housing;

a guide post extending forward beyond a front of the shielding member;

a cap fixed to a free end of the guide post;

a washer axially moveably positioned on the guide post with a larger radius than the cap;

resilient means positioned between the washer and the shielding member for urging the washer to abut against the cap; and a second connector defining a mating face adapted to confront the shielding member, a hole extending inward from said mating face of the second connector and dimensioned to snugly receive the cap therein and to prevent insertion of the washer therein.

18. The connector assembly as claimed in claim 17, wherein said washer is urged by the resilient means to abut against the mating face of the second connector.

* * * * *